United States Patent [19]

McCann

[11] 4,210,325

[45] Jul. 1, 1980

[54] CUE GUIDE APPARATUS

[76] Inventor: Arthur T. McCann, P.O. Box 6368, Odessa, Tex. 79762

[21] Appl. No.: 906,690

[22] Filed: May 16, 1978

[51] Int. Cl.[2] ..... A63D 15/10

[52] U.S. Cl. ..... 273/24

[58] Field of Search ..... 273/23, 24

[56] References Cited

U.S. PATENT DOCUMENTS

| | | | |
|---|---|---|---|
| 242,877 | 6/1881 | Bryant | 273/24 |
| 570,459 | 11/1896 | Cronin | 273/24 |
| 774,621 | 11/1904 | Van Setres | 273/24 |
| 1,105,478 | 7/1914 | Ames | 273/24 |
| 1,149,834 | 8/1915 | James | 273/24 |

*Primary Examiner*—Richard C. Pinkham
*Assistant Examiner*—T. Brown
*Attorney, Agent, or Firm*—Marcus L. Bates

[57] ABSTRACT

A cue guide apparatus for use in playing billiards. The apparatus is of unitary construction and includes a cue stick receiving guide member which extends from two adjacent, finger-receiving apertures. The apparatus is fitted to a person's index and second fingers, the hand is placed palm down on the field of play of a billiard table in a relaxed manner, and a conventional cue stick is placed such that it is bottom supported within the guide member and reciprocated respective thereto, whereby a billiard ball can be struck by the end of the cue stick with great accuracy.

4 Claims, 10 Drawing Figures

CUE GUIDE APPARATUS

BACKGROUND OF THE INVENTION

In playing billiards, it is essential that both hands be used to manipulate the cue stick in such a manner that the stick is moved along its longitudinal axial centerline towards the geometrical center of the cue ball, or towards a predetermined location on the outer surface of the ball. The most common support for the cue stick is the left hand, which is placed plam down about six inches from the ball. The fingers of the left hand are contorted into a saddle comprised of the thumb, index, and middle finger. Most beginners are discouraged from playing billiards because of the difficulty experienced in forming the saddle.

The more feminine species of our sex, and especially delicately constructed females, experience difficulty in forming the hand into a suitable saddle or cue guide, such as exemplified by FIG. 3 of U.S. Pat. No. 4,053,153. For this reason, various different approaches have been made in order to overcome this inability, such as exemplified by U.S. Pat. Nos. 3,563,543; 1,092,189; 453,797; 2,931,649; 2,399,931; 2,817,525; 3,836,145; and 3,416,794.

However, in each of the above recited prior art references, the mechanical guide relied upon is complex in design and in some instances requires modification of the cue stick itself.

In order to make the game of billiards more attractive to everyone, it is desirable that there be provided a cue stick guide apparatus which is inexpensive, small enough to be carried on one's person so that it is available at all times, attractive in appearance so as to be acceptable to the more fastidious segment of billiard playing society, and especially is of a design which improves one's ability to play billiards.

Accordingly, the present invention provides a device which eliminates the necessity of contorting the hand into a saddle, and which enables the beginner to concentrate on the details of the game rather than upon the abstract proposition of contemplating his distorted hand.

SUMMARY OF THE INVENTION

The present invention provides a cue guide apparatus which is simple in design, low in cost, sufficiently small to be carried about on one's person, and which enhances the beginner's ability to play billiards.

Specifically, the cue guide apparatus comprises a bridge member which connects together two adjacent, finger-receiving members. A guide member extends away from the finger members and bridge member, and slidably receives a cue stick in a bottom supported manner.

The finger-receiving members are spaced apart and made into a configuration to receive the index and second finger of one's hand therewithin, with the guide member being conveniently disposed between the forefinger and thumb, so that when one's hand is placed palm down upon the field of play of a billiard table, the guide is elevated above the surface of the table in properly aligned relationship where it can guidably support and reciprocatingly receive a cue stick in a slidable manner.

This enables the cue stick to be properly supported above the surface of a billiard table so that the end of the stick can be aimed directly towards the geometrical center of the billiard ball, thereby enabling the ball to be struck with great accuracy by the cue stick.

Accordingly, a primary object of this invention is the provision of a cue guide apparatus which enhances one's ability to play billiards.

Another object of the invention is the provision of a cue guide apparatus which can be fitted onto one's hand in a manner to increase the accuracy with which a cue ball is struck by a cue stick.

A further object of this invention is to disclose and provide a cue guide apparatus which is sufficiently small to be carried about on one's person, which is attractive in appearance, and low in cost.

A still further object of this invention is to provide a cue guide apparatus which bottom supports a cue stick while the stick is being used to strike a cue ball.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
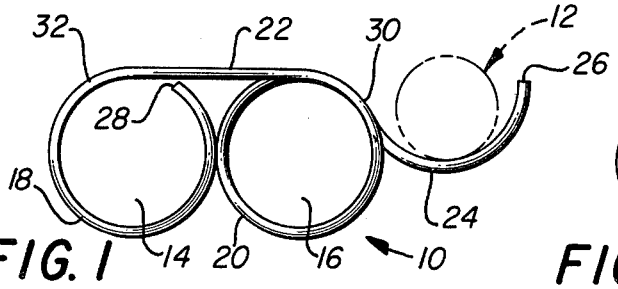
FIG. 1 is a front elevational view of a cue guide apparatus made in accordance with the present invention.

In FIG. 1, there is disclosed a cue guide apparatus 10 for use in playing billiards. A cue stick 12 of usual construction is bottom supported by the apparatus. Finger-receiving apertures 14 and 16, respectively, are formed by finger-receiving members 18 and 20, respectively. Bridge member 22 connects the two finger-receiving members together in spaced-apart relationship respective to one another. A cue guide member 24 is spaced from the bridge and includes a free or terminal end 26.

The apparatus 10 preferably is fabricated from a length of bent up metal defined by end portions 26 and 28. Numeral 30 indicates a juncture or crossing of the length of bent up material. The juncture is common to the bridge, finger-receiving member 20, and guide member 24. Numeral 32 indicates the general area where the bridge and finger-receiving member 18 are joined together.

End 28 can be extended into proximity of area 32 if desired, while member 24 can be continued such that end 26 circumferentially continues in a counter-clockwise direction towards juncture 30. Juncture 30 preferably is a crossing of the bent up metal member rather than a rigid attachment point, so that the diameters of the apertures 14 and 16, as well as the position of guide member 24, can be adjusted as may be desired.

Figure 3:
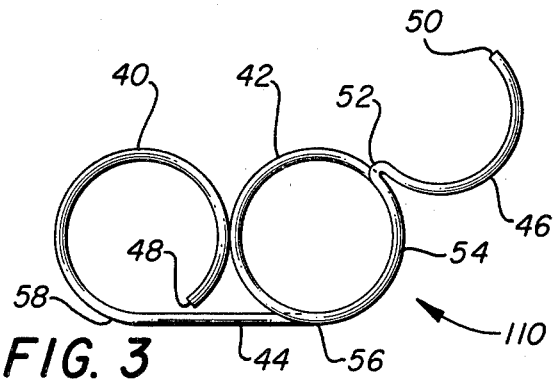
FIG. 3 sets forth an alternate embodiment of the apparatus disclosed in the foregoing figures.
Figure 4:
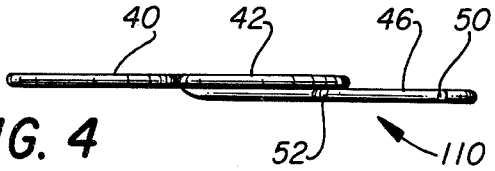
FIG. 4 is a top plan view of the apparatus disclosed in FIG. 3.

In the embodiment set forth in FIG. 3, the cue guide apparatus 110 is comprised of spaced, adjacent, finger-receiving members, 40 and 42, which are joined together by bridge member 44. Guide member 46 is spaced from the bridge by a circumferentially extending portion of the finger-receiving member 42. The guide apparatus preferably is fabricated from a bent up piece of metal having terminal ends 48 and 50.

Figure 7:
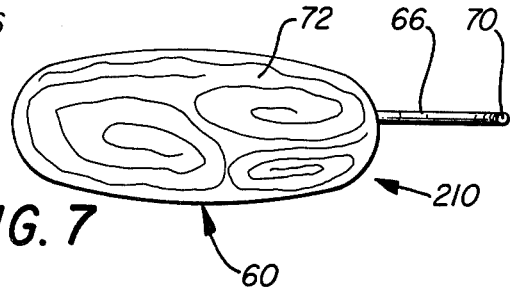
FIG. 7 is a top plan view of the apparatus disclosed in FIGS. 5 and 6.
Figure 2:
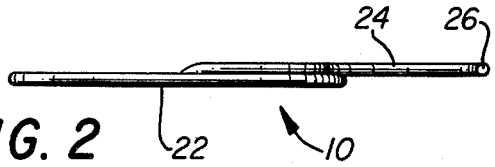
FIG. 2 is a top plan view of the apparatus disclosed in FIG. 1.
Figure 5:
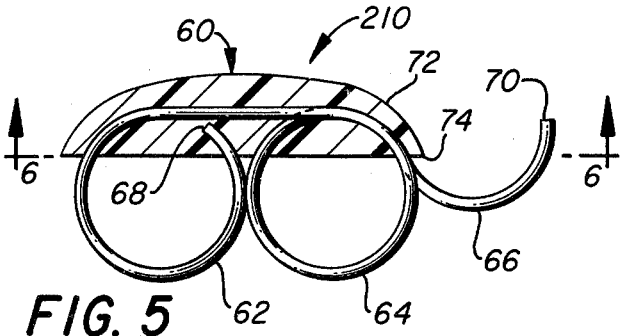
FIG. 5 is a part cross-sectional view taken along line 5—5 of FIG. 6 which discloses another embodiment of a cue guide apparatus made in accordance with the present invention.
Figure 6:
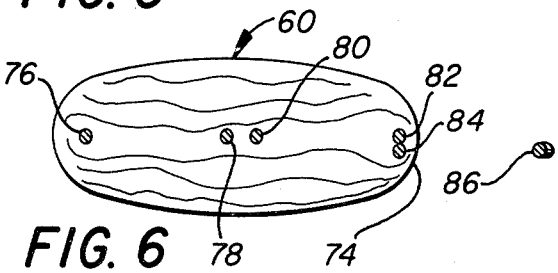
FIG. 6 is a cross-sectional view taken along line 6—6 of FIG. 5.

In the embodiment of FIG. 5, the cue guide apparatus 210 includes a member 60 which has structural utility as well as an artistic or ornamental utility. As seen in the illustration of FIGS. 5–7, the ornament 60 preferably is made of plastic material such as "Clear Cast" which contains Styrene and Esters and is available from Handicrafts Company of Fort Worth, Texas. Other epoxy resins admixed with various pigments to resemble a precious stone, such as jade, for example, can be used. Finger-receiving members 62 and 64 include the before mentioned bridge member and guide member 66, with the bridge member and the upper marginal portions of the finger-receiving members being embedded within the cast ornament 60. Accordingly, the ornament 60 forms part of the bridge member, increases the area of contact across the top of the hand, and provides an edge portion 74 against which the cue stick can ride as it is reciprocated towards the cue ball.

Figure 8:
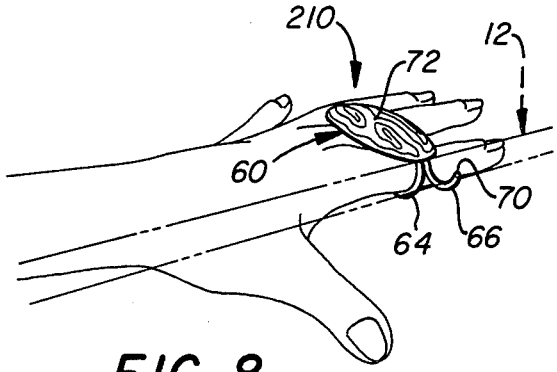
FIG. 8 is a perspective view of a cue guide apparatus mounted on one's hand.

As seen in FIG. 8, the cue guide apparatus of the present invention is received about the forefinger and second finger in such a manner that the guide member extends away from the bridge member as well as the finger-receiving members. The guide member comes to rest in proper aligned relationship respective to the cue stick when the hand is laid palm down in a relaxed manner on the top surface of a billiard table.

Figure 9:
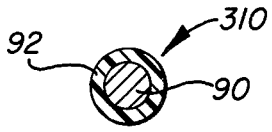
FIG. 9 is a cross-sectional view of another form of the present invention.

In FIG. 9, there is disclosed a cross-sectional view of an elongated piece of metal made into the configuration previously disclosed in FIGS. 1–4. As seen in FIG. 9, the metal 90 is copper, preferably 14 gauge, which has been heated to approximately 420° F., and dipped into a fluidized bed of epoxy powder, thereby providing a generous coating 92. The coating thickness can be varied according to the residence of the heated member 90 within the fluidized bed. The color of the coating, as well as its composition, can be varied, as is known to those skilled in the coating art. The powder is available from The Polymer Company of Reading, Pennsylvania, and is known as Corvell 501 Epoxie Powder.

Figure 10:
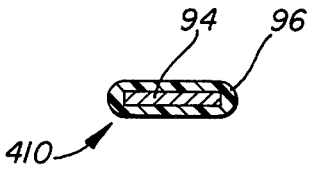
FIG. 10 sets forth still another embodiment of the present invention.

In FIG. 10, there is disclosed still another embodiment 410 of the invention which comprehends a flat piece of metal 94, as for example a piece of malleable steel or cold rolled iron approximately 1/16 inch thickness and ⅜ inches wide which has been heated and dipped into a fluidized bed of plastic as in the before described manner. The metal 94 is bent into the configuration of the apparatus disclosed in either of the FIGS. 1–8.

I claim:

1. A cue guide apparatus for use in playing billiards comprising a bridge member, two adjacent, finger-receiving members connected by said bridge member, and a guide member extending away from said bridge member for receiving a cue stick therewithin;

said finger-receiving members are spaced apart apertures which are arranged to receive the first and second finger of one's hand therewithin with said guide member being disposed between the forefinger and thumb;

said bridge member, said two finger-receiving members, and said guide member are of unitary construction;

said bridge member and the adjacent marginal portions of said finger receiving members are encased within an ornamental member, said ornamental member having an upper and a lower surface, said lower surface having a substantially planar area of greater transverse dimension than the bridge and finger receiving members such that said lower surface is received against the top of one's hand for increasing the area of contact across the top of the fingers when the cue guide apparatus is affixed to one's fingers when the bridge wearing hand is placed palm down upon a billiard table, said guide is elevated above the surface of a table for reciprocatingly receiving a cue stick in a slidable manner therewithin.

2. The cue guide apparatus of claim 1 wherein said bridge member, finger receiving members, and guide member are fabricated from a single length of bent-up metal.

3. The cue guide apparatus of claim 2 wherein said ornamental member has a downwardly curved upper surface, one side of which extends away from said finger-receiving member and into overlying relationship respective to said guide member so that a cue stick simultaneously contacts a marginal surface of said ornamental member and a marginal surface of said guide member.

4. A cue guide apparatus having a cue guide member and spaced, adjacent, finger-receiving members;

a bridge member connecting said finger-receiving members and said cue guide member together such that when the apparatus is placed about the first and second fingers of one's hand, and one's hand is placed palm down on a billiard table, the cue guide member is positioned between the thumb and first finger in an elevated position respective to the surface of a billiard table;

said cue guide member having a curved surface which supports a cue stick such that the stick can be slidably reciprocated respective thereto;

said bridge member, said finger-receiving members, and said cue guide member being fabricated from a single continuous length of bent material;

an ornamental member rigidly attached to said bridge member and said finger receiving members, said ornamental member having a lower substantially planar surface of greater transverse dimension than said bridge and finger receiving members for increasing the area of contact across the top of the fingers when said cue guide is affixed to one's fingers, said ornamental member further having an upper curved surface, a marginal edge portion of said curved surface extending into overlying relationship respective to a marginal edge portion of said cue guide member so that a cue stick when placed in said cue guide member is simultaneously contacted by said ornamental member and said cue guide member.

* * * * *